United States Patent [19]

Baltsch et al.

[11] Patent Number: 4,538,408

[45] Date of Patent: Sep. 3, 1985

[54] METHOD AND APPARATUS FOR CONTROLLING THE THREAD JOINING PROCESS IN AN OPEN END ROTOR SPINNING MACHINE

[75] Inventors: Erwin Baltsch, Nettetal; Heinz-Dieter Göbbels, Monchen-Gladbach; Hans Grecksch, Monchen-Gladbach; Manfred Lassmann, Nettetal; Hans Raasch, Monchen-Gladbach; Helmut Schlösser, Viersen, all of Fed. Rep. of Germany

[73] Assignee: W. Schlafhorst & Co., Monchen-Gladbach, Fed. Rep. of Germany

[21] Appl. No.: 441,231

[22] Filed: Nov. 12, 1982

[30] Foreign Application Priority Data

Nov. 11, 1981 [DE] Fed. Rep. of Germany ..... 3144776

[51] Int. Cl.[3] ..... D01H 15/02

[52] U.S. Cl. ..... 57/263; 57/264

[58] Field of Search ..... 57/263, 264

[56] References Cited

U.S. PATENT DOCUMENTS

| | | | |
|---|---|---|---|
| 3,939,638 | 2/1976 | Bruckert et al. | 57/263 |
| 3,987,610 | 10/1976 | Stahlecker et al. | 57/263 |
| 4,020,621 | 5/1977 | Tsubata | 57/263 |
| 4,020,622 | 5/1977 | Lattion | 57/263 |
| 4,080,775 | 3/1978 | Stahlecker | 57/263 |
| 4,102,116 | 7/1978 | Derichs et al. | 57/263 |
| 4,159,616 | 7/1979 | Takeuchi et al. | 57/263 X |
| 4,172,357 | 10/1979 | Stahlecker et al. | 57/263 |

*Primary Examiner*—Donald Watkins

*Attorney, Agent, or Firm*—Herbert L. Lerner; Laurence A. Greenberg

[57] ABSTRACT

Method for controlling a thread joining process having several thread joining steps and occuring by starting a rotor of an open end rotor spinning machine, which includes choosing a narrow limited rotor speed range for the beginning of a starting process of a specific thread joining step, which occurs after a first thread joining step, and selectively starting and finishing thread joining steps in substantially constant given intervals before and after the beginning of the starting process, and an apparatus for carrying out the method.

18 Claims, 5 Drawing Figures

Figures 1A, 1B, 1C:
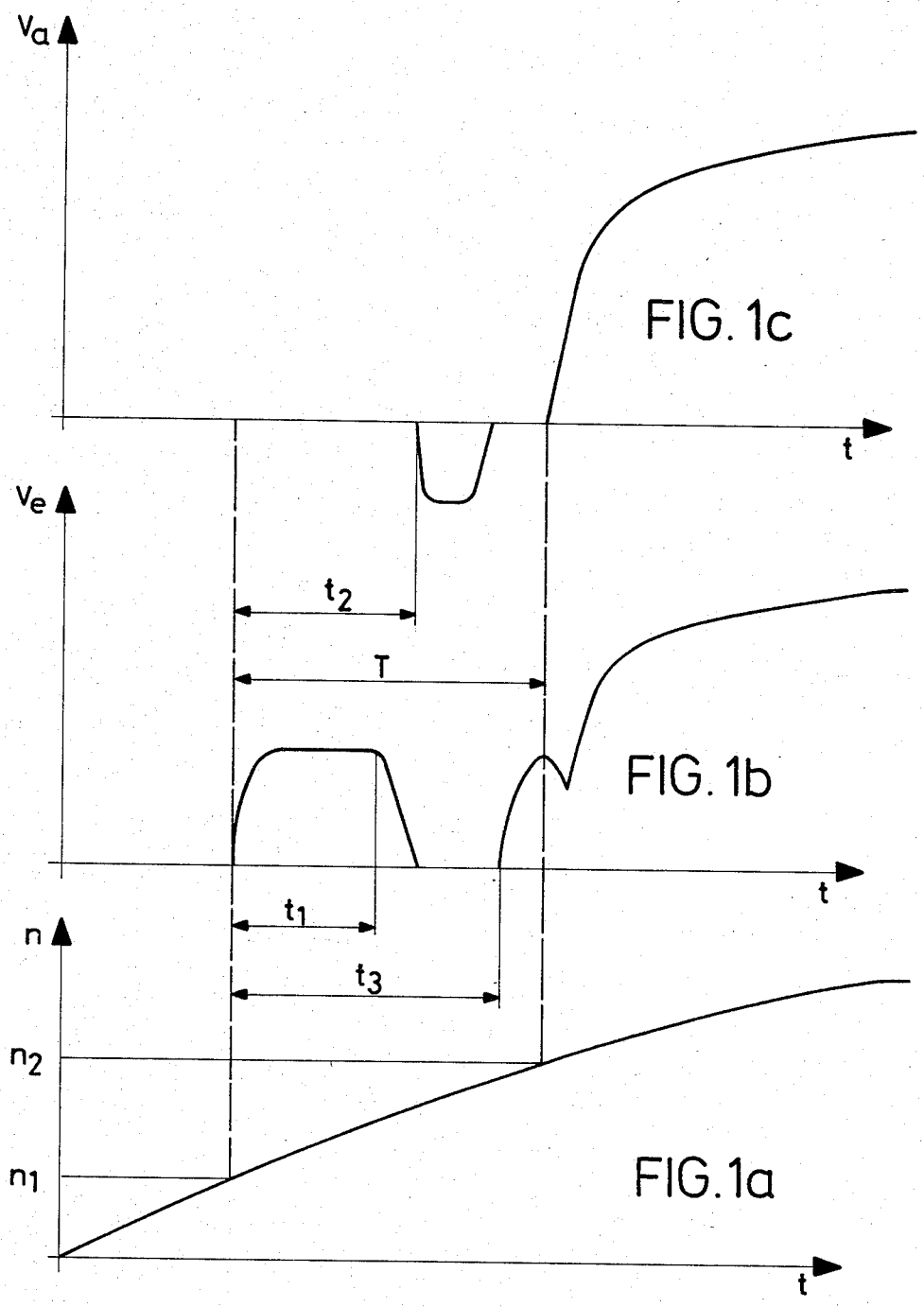

$V_a$
t $V_e$
$t_2$
T t
$t_1$
n
$t_3$
$n_2$
$n_1$ t

METHOD AND APPARATUS FOR CONTROLLING THE THREAD JOINING PROCESS IN AN OPEN END ROTOR SPINNING MACHINE

The invention relates to a method and apparatus for the control of a thread joining process, which occurs by starting a rotor in an open end rotor spinning machine.

It is known from German Published, Non-Prosecuted Application DE-OS 26 05 978 to begin to spin at a lower speed than the normal speed during the starting of the rotor and thereby to start and/or end the individual processes at certain rotor speeds.

Security of the joining thread results, when the control is constructed in such a way that the doffing of the thread joining from the rotor occurs at a rotor speed of between 30,000 and 40,000 revolutions per minute, the so-called thread joining speed. Before this moment, the fiber quantity which is necessary for the thread joining must be brought into the rotor as a pre-fed quantity and the thread is combined with the pre-fed fibers. In order for such steps to be finished before the thread joining speed is reached, the thread joining process must begin, at an average starting time of the rotor, at a speed of between 5,000 and 10,000 revolutions per minute. However, it is seen in practice that the rotor starting time spreads in the ratio of 1 to 3 at one and the same spinning unit, as well as at the parallel working units. This is, among other things, taken into consideration through the different coefficients of friction between the driving belt and the rotor driving whorl, and through the dispersion of the belt contact pressure even through different inertia moments of the rotor.

Because of the different lengths of the rotor starting times, the fed quantity of fiber is different, and it results in different lengths of intervals between the pre-feeding, the return of the thread and the unwinding of the thread joining. By stopping the pre-feeding, no immediate stop of the fiber flow takes place. From the sliver which is standing still, other fibers are still combed out, and the fiber flow only reduces slowly. It has been discovered that 10 minutes after the cut-off of the sliver drawing-in, single fibers are still becoming loose from the connection. The subsequently fed fibers increase the fiber quantity of the pre-feeding, depending upon the waiting period before the thread unwinding. The result is that the thread joining position is unevenly thick. Besides, the combed out fibers during the waiting period are missing when restarting the sliver drawing-in. Therefore, it is possible that after a piecer which is too thick, the following thread could be too thin.

It is accordingly an object of the invention to provide a method and apparatus for controlling the thread joining process in an open end rotor spinning machine, which overcomes the hereinafore-mentioned disadvantages of the heretofore-known methods and devices of this general type and to improve the automatic thread joining, thereby increasing the strength and the evenness of the piecer and the adjoined thread pieces.

With the foregoing and other objects in view there is provided, in accordance with the invention, a method for controlling a thread joining process having several thread joining steps and occuring by starting a rotor of an open end rotor spinning machine, which comprises choosing a narrow limited rotor speed range for the beginning of a starting process of a specific thread joining step, which occurs after a first thread joining step, and selectively starting and/or finishing thread joining steps sooner or later in substantially constant given intervals before or after the beginning of the starting process.

In order to carry out the method there is provided an apparatus for controlling a thread joining process having several thread joining steps and occuring by starting a rotor of an open end rotor spinning machine, comprising at least one spinning unit of the open end rotor spinning machine, a control device connected to the at least one spinning unit for controlling pre-feeding of a fiber quantity required for thread joining and for controlling commercial or workable spin fiber feeding to the rotor, for returning the joined thread end to the rotor and for at least temporarily controlling thread unwinding from the rotor for the duration of the joining process, a thread unwinding device and a sliver drawing-in device connected to the control device at least for the duration of the thread joining process, the control device including an adjustable timer for the sequence and duration of individual thread joining steps of the thread joining process, means disposed in vicinity of the rotor for production of rotor signals, means connected to the signal production means for evaluating at least one measured variable from the rotor signals based on acceleration of the rotor, and a start element connected between the timer and the evaluating means for responding to a selectable value of the measured variable and starting a first thread joining step.

An advantage obtained with the invention exists especially in that an equally large fiber quantity is always fed in as a pre-feeding, whereby the beginning of the thread unwinding can be put in the sphere of optimal rotor speed. Furthermore, the invention still has the advantage that at the moment of the beginning of the fiber pre-feeding, the rotor does not have too low a speed. In the past, the start of the fiber pre-feeding had to be transferred into the low speed range in consideration of extremely quickly starting rotors, which led to shoving of the fibers in the rotor groove, one upon the other, while the fibers had a higher speed than the groove wall. The shoving of the fibers one upon the other led to a fiber lump, which again resulted in a high spot in the thread in the area of the piecer.

According to the invention, the thread joining process preferably begins with the start of the pre-feeding according to the rotor acceleration. The other working steps of the thread joining are started and/or ended in given time periods.

The invention stems from the consideration that it should begin with the thread unwinding in a favorable speed range of the rotor, and that before a certain fiber quantity should exist in the rotor, it should spread as equally as possible. An approximately determined fiber quantity can be pre-fed, and constant sliver can be provided, when the pre-feeding is started at a predetermined time, and then run up to a maximum value, for a moment remains constant, and then is cut out and subsequently runs down.

When $n_2$ is the given rotor speed, at which the thread unwinding should begin, when $n_1$ is the rotor speed, the given time interval, which should be between $n_1$ and $n_2$, then counts for the determination of the rotor speed, when reaching or exceeding the pre-feeding is to start according to:

$$n_1 = n_2 - T \cdot a,$$

wherein "a" refers to the rotor acceleration, which can be determined through differentiation of the rotor speed according to time. For this purpose, for example, a micro processor, a digital computer or an analog differentiator can be used.

In this case, the beginning of the thread unwinding is defined as those thread joining steps, from which temporarily previous thread joining steps have approximately constant preselected intervals, respectively. However, a special starting process can be connected to the actual thread unwinding, which, for example, is available in that the thread end, which leads back into the rotor first gets a twist, whereby a tuft of fibers is already set up at the thread end.

The differentiation is to begin at the latest, a short period after the start up of the rotor, so that a high rotor acceleration the time of the thread joining process does not lie within the differentiation time or computing time, respectively. Furthermore, the danger exists that the differentiator will become especially inexact at lower rotor acceleration. To avoid this, it is suggested, in other features of the invention, that the first thread joining step be started after a point of time is reached, while the value of a measured variable A is equal to or larger than the value of a measured variable B. The measured variable A expresses the number of the revolutions of the rotor and the measured variable B expresses the quotient from the given rotor speed for the beginning of the starting process of the thread unwinding, multiplied by the square of the starting time, and the sum from the given time intervals, which are between the start of the first thread joining step and the beginning of the starting process of the thread unwinding, and the starting time of the rotor. The necessary calculations and comparisons, for example, can be carried out quickly in small intervals with a digital computer.

When the beginning of the pre-feeding is chosen as the first thread joining step and $n_2$ is the given rotor speed for the beginning of the starting process of the thread unwinding, T is the time interval, which is between the beginning of the pre-feeding and the beginning of the start process of the thread unwinding, and z is the number of the rotor revolutions, which belongs to the starting time t of the rotor, as follows:

$$z = \frac{n_2 \cdot t^2}{T + t}$$

Another possibility suggests that from the first, the measured variable B is calculated and is stored in a memory, by starting the rotor, the value of the measured variable B, which belongs to the momentary starting time, is continuously compared with the measured value A, and then the first thread joining step is started after the point of time is reached, when the value of the measured variable A is equal or larger than the value of the measured variable B. The memory, such as an electrical memory, is also scanned in short intervals and the results are compared with the number of the revolutions of the rotor.

An alternative is suggested, which is that during the starting, the rotor speed is continuously measured and the first thread joining step is started after a point of time is reached, when the value of a measured variable C is equal to or larger than the value of a measured variable D. The measured variable C expresses the rotor speed and the measured variable D expresses the difference between the given rotor speed for the beginning of the starting process of the thread unwinding and a measured variable E. The measured variable E expresses the quotient, from which the given rotor speed for the beginning of the starting process of the thread unwinding is multiplied by the time difference between the starting time of the first thread joining and the beginning of the starting process of the thread unwinding, divided by the given rotor starting time until the beginning of the starting process of the thread unwinding.

The underlying relations are explained as follows: When the beginning of the pre-feeding is chosen as the first thread joining, reference symbol $n_2$ stands for the rotor speed at the beginning of the starting process of the thread unwinding, $n_1$ stands for the rotor speed at the beginning of the pre-feeding, T stands for the time interval which is between the beginning of the pre-feeding and the beginning of the starting process of the thread unwinding, t stands for the rotor starting time and "a" stands for the acceleration, therefore:

$$n_1 = n_2 - T \cdot a = n_2 - T \cdot (n_2/t)$$

These relationships correspond to the charge function of an electrical capacitor after the conversion. The beginning of the starting process of the thread unwinding can also coincide with the beginning of the thread unwinding, when no additional starting process is connected in series, as defined above.

Before the thread joining, supposed values of the measured variable D, which are for different starting times, can be determined and stored advantageously in a memory, so that at the starting of the rotor, the value of the measured variable C is continuously compared with the accepted value of the measured variable D, which corresponds to the respective starting time, and whereby the thread joining process is then started after the point in time is reached when the value of the measured variable C is equal to or larger than the value of the measured variable D. This memory function can be transferred to an electrical capacitor, which is loaded at the beginning of the starting of the rotor, for which a voltage is produced that is proportional to the rotor speed and is continuously compared with the capacitor voltage. The thread joining process is started after the point in time is reached when both voltages are equal.

The technical expenditure can be decreased when, according to another feature of the invention, the number of rotor revolutions is measured during a constant given starting time. The earlier the starting of the first thread joining step, the larger the measured number of revolutions. Instead, when reaching a given number of rotor revolutions, the necessary starting time can be measured, so that the earlier the starting of the first thread joining step, the shorter the measured starting time.

The end phase of the thread joining process is unstable in the normal spinning operation. This suggests that after the beginning of the thread unwinding, the thread unwinding speed is controlled according to the rotor speed and the sliver drawing-in speed is controlled according to the thread unwinding speed. This variant of the process has the advantage of avoiding inadmissible draft changes of the thread during the thread joining and at the beginning of the normal operation. While the unwinding speed acts according to the rotor speed, the unwinding apparatus can, however, not always follow the increasing rotor speed fast enough, as a rule, which results in a somewhat higher thread rotation than normal, but is harmless. The drawing-in speed would now likewise follow the rotor speed, and the sliver drawing-in apparatus would exactly follow the normal values because of its lower speed and the less accelerated mass. This should result in a draft which is too small, so that the thread would acquire a high spot. The suggested dependence of the sliver drawing-in speed on the thread unwinding speed avoids this disadvantage.

Advantageously, after the beginning of the pre-feeding, the pre-feeding speed is controlled according to the chosen draft. In this way, the fiber quantity is secured at a constant pre-feeding time corresponding to the fineness of the yarn, as it pre-feeds into the rotor. It is this one fiber quantity, which makes up 50 to 70 percent of the fibers existing in the desired finished thread cross section. At the end of the pre-feeding, such fibers are equally spread in the fiber collecting groove of the rotor. Other features which are considered as characteristic for the invention are set forth in the appended claims.

Although the invention is illustrated and described herein as embodied in a method and apparatus for controlling the thread joining process in an open end rotor spinning machine, it is nevertheless not intended to be limited to the details shown, since various modifications and structural changes may be made therein without departing from the spirit of the invention and within the scope and range of equivalents of the claims.

Figure 2:
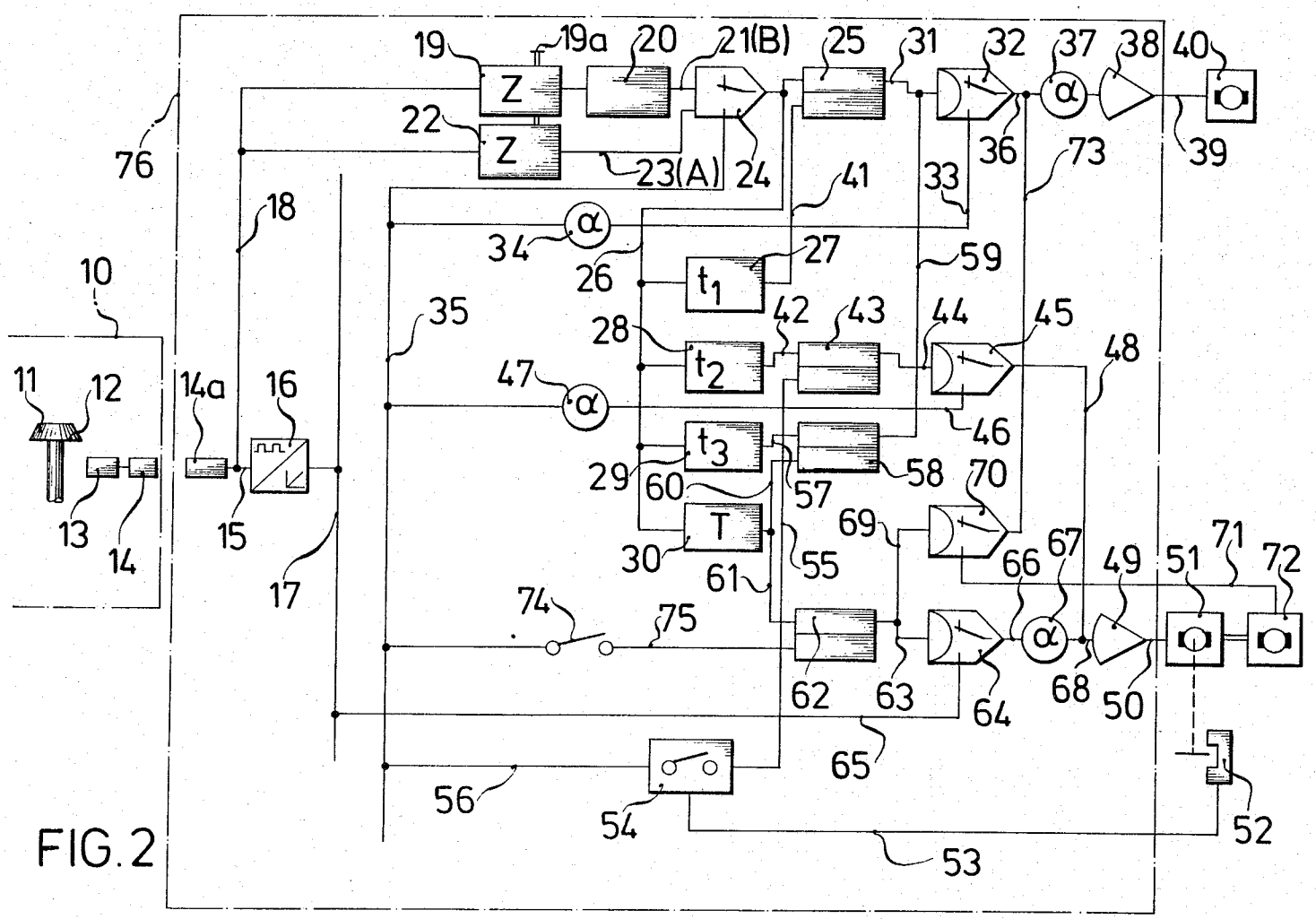
Figure 3:
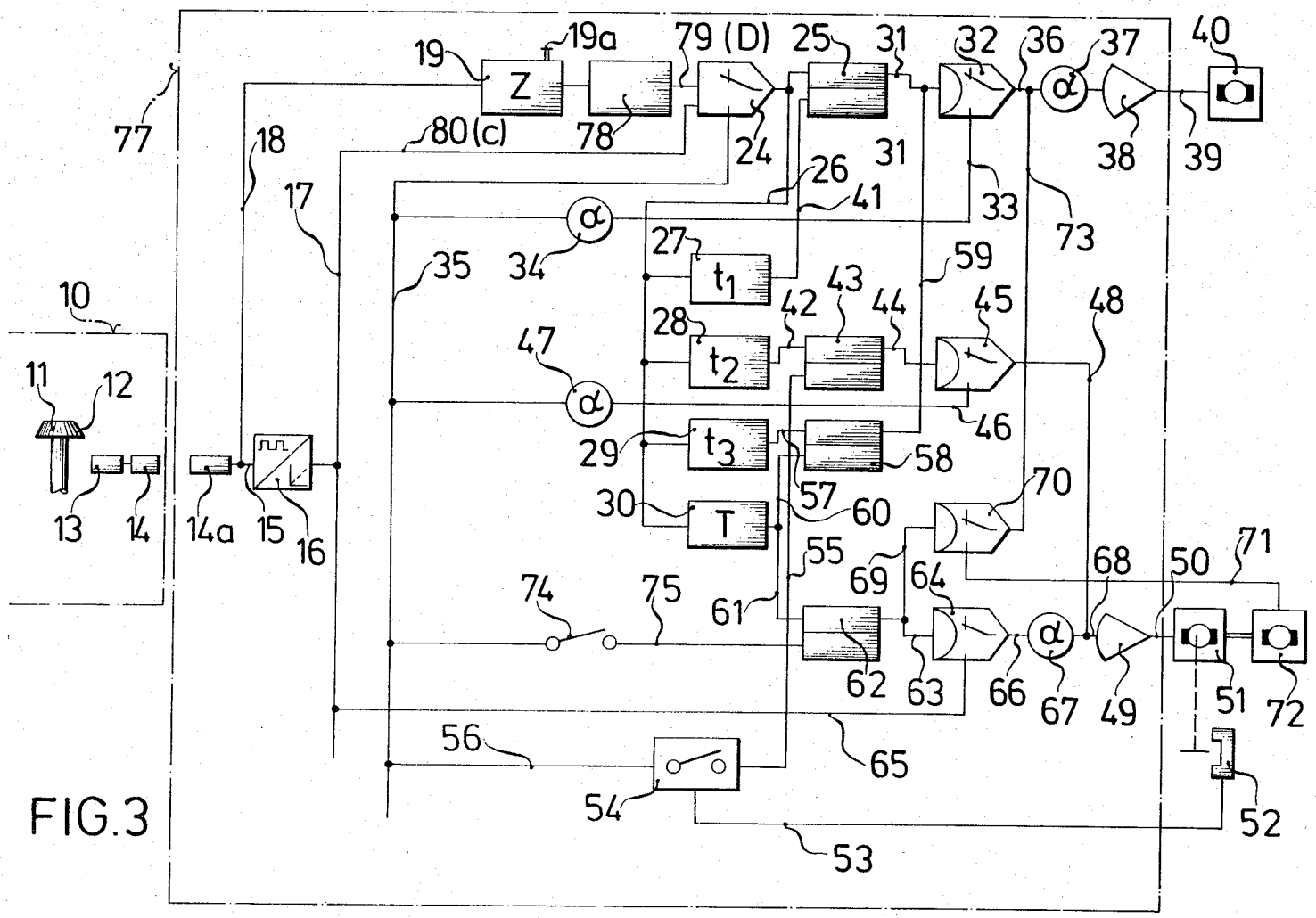

The construction and method of operation of the invention, however, together with additional objects and advantages thereof will be best understood from the following description of specific embodiments when read in connection with the accompanying drawings, in which:

FIGS. 1*a*, 1*b* and 1*c* are graphical illustrations of the behavior of the rotor speed in the same time scale, of the fiber feeding speed (including the pre-feeding) and of the unwinding speed (including the return speed of the joined thread end); and FIGS. 2 and 3 are diagrammatic and schematic circuit diagrams of the control apparatus, according to the invention.

Referring now to the figures of the drawing and first particularly to FIGS. 1*a*, 1*b* and 1*c* thereof, it is seen that at the rotor speed $n_1$ the thread joining process is started as the first thread joining step by switching on the pre-feeding. Other working steps of the thread joining process then follow at previously chosen given intervals. After the end of the time interval $t_1$, the pre-feeding is switched off. The fiber feeding apparatus has a certain run out so that the fiber feed comes to an approximate standstill only after a delay, and about then, after the end of the time interval $t_2$, the return of the joined thread end to the rotor begins. The end of the return movement is not time-dependent and is controlled through a signal, which is dependent on the thread length. The return movement is then ended, when fiber feeding is started after the end of the time interval $t_3$. The fiber feeding then follows the behavior of the curve of the pre-feeding. It is only after the end of the time interval T when the starting process of the thread unwinding begins, that the sliver drawing-in speed is controlled according to the thread unwinding speed and the thread unwinding speed is controlled according to the rotor speed.

At the start of the fiber pre-feeding, the drive motor starts a sliver drawing-in apparatus. After the end of the time interval $t_1$ the fiber pre-feeding is switched off, to permit an undisturbed preparation or setting of the thread end to the fiber ring in the fiber collecting groove of the rotor.

An optimal fiber quantity which can be empirically determined, must be fed in advance in order to obtain a good thread joining unit.

The thread joining end is previously made ready through the thread joining apparatus. After the end of the time interval $t_2$ the return of the joined thread end is started into the rotor. This happens, for example, because the rollers of a thread unwinding apparatus, which hold the thread end, are switched on opposite to the direction of rotation of the unwinding. The behavior of the return speed of the joined thread end is represented in FIG. 1*c*. A small pause lies between the end of the return and the beginning of the thread unwinding. The return should take place at a high speed. The length of the thread end, which is fed to the rotor can, for example, be determined through digital determination of the angle of rotation of the discharge roller.

After the return thread end is connected to the fiber ring, which is available in the fiber collecting groove of the rotor, the respective fiber feeding and sliver drawing-in is started again after the end of the time interval $t_3$. The time difference between the start of the sliver drawing-in and the beginning of the thread unwinding results from the time delay of the fiber flow during drawing-in. The time delay is specifically planned, among other things. The thread unwinding should only begin when the fibers actually arrive in the rotor groove.

FIG. 2 shows a block circuit diagram of a control apparatus 76 according to the invention; with its help the thread joining process will be started according to the sum of the rotor revolutions.

A spinning unit 10 of an open end rotor spinning machine, which is indicated by outlining, has a rotor 11. The fiber collecting groove of the rotor is indicated by reference numeral 12. From the rotor 11 digital signals are produced in a receiver 13, and are transferred from a sender 14 to a receiver 14*a*. The digital signals travel in a digital/analog converter 16 through a line 15. The digital/analog converter 16 applies a voltage to a line 17, which is proportional to the rotor speed. After the actuation of a start key 19*a*, the digital signal travels over a line 18 to a counter 19, the output of which is connected to the input of a calculator or computer 20. The calculator 20 delivers a measured variable B at its output 21, which expresses a quotient from the given speed of the rotor, for the beginning of the starting process of the thread unwinding, multiplied by the square of the starting time, and the sum from the given time of the interval between the start of the first thread joining step and the beginning of the starting process of the thread unwinding and the starting time of the rotor.

A second counter 22 connected to the line 18 likewise adds the number of the rotor impulses after the actuation of the start key 19*a*. At the output 23 of the counter 22 a measured variable A can be taken off, which expresses the number of revolutions of the rotor 11. The two measured variables A and B lead into a comparator 24, which serves as a start element. As soon as the value of the measured variable A is equal to or larger than the value of the measured variable B, the comparator is connected through and a memory 25 is set.

Over a line 26, which serves as an operative connection, time elements 27 for the time $t_1$, 28 for the time $t_2$, 29 for the time $t_3$ and 30 for the time T are started simultaneously. The time elements 27, 28, 29 and 30 form a common adjustable timer installation. Through setting the memory 25, a digital/analog circuit 32 is connected to a line 33 through a line 31, the line 33 is connected to a collecting main or line 35 through a potentiometer 34, and the collecting line 35 has a constant voltage. The adjusted voltage at the potentiometer 34 is now at the output 36 of the circuit 32. This voltage is the fundamental voltage of the feeding, and for the present, still the pre-feeding. Through a potentiometer 37, at which the draft is adjustable, the fundamental voltage will be brought to a value, which is necessary for the fineness of the yarn. An amplifier 38 is connected to the output of the potentiometer 37. The amplifier 38 feeds the motor of a sliver drawing-in apparatus 40 over a line 39.

In the operational state described up to now, the sliver drawing-in apparatus 40 remains connected until the end of the time interval $t_1$. Then the memory 25 is erased through the time element 27 over the line 41. This results in the switching off of the circuit 32 and thereby in the sliver drawing-in apparatus 40 being out of operation. As soon as the sliver drawing-in apparatus 40 stands still, the pre-feeding is ended.

After the end of the time interval $t_2$, the time element 28 sets a memory 43 over a line 42. Through the onset of the memory 43, a digital/analog circuit 45 is connected to a line 46 over a line 44, and the line 46 is connected to the collecting main 35 through the potentiometer 47. The adjusted voltage at the potentiometer 47 now lies at the line 48 and thereby at the input of an amplifier 49. The amplifier 49 feeds the motor of a combined thread unwinding and return apparatus 51 over a line 50 in reverse, and also in the thread return operation. The thread joining end is thereby fed back into the rotor 11.

At the thread unwinding and return apparatus 51, an impulse generator 52 is connected, which at each turn, for example, gives an impulse to the control input of a counter 54 over a line 53. As soon as a given number of impulses is reached, which corresponds to the return thread length, the erasing input of the memory 43 receives a voltage from the collecting main 35 over a line 55, the through-connected counter 54 and a line 56 receiving a voltage from the collecting main 35, so that the memory 43 is again erased. This brings about the switching off of the circuit 45 and thereby stops the operation of the apparatus 51. As soon as the apparatus 51 stands still, the thread return is ended.

After the end of the time interval $t_3$ the time element 30 sets a memory 58 over a line 57. Through the onset of the memory 58 the digital/analog circuit 32 is again connected to the line 33 over a line 59, so that the sliver drawing-in apparatus 40 is likewise again in operation. The feeding starts again, beginning with the pre-feeding speed.

After the end of the time interval T the time element erases the memory 58 over a line 60 and sets a memory 62 over a line 61. Through the onset of the memory 62, a digital/analog circuit 64 is connected to a line 65 over a line 63, which is connected to the line 17. Therefore, the output 66 of the circuit 64 is a voltage, which is proportional to the rotor speed. Through an after-connected potentiometer 67, at which the thread rotation is adjustable, the voltage is changed according to the desired thread rotation and is fed into the amplifier 49 over a line 68. The amplifier 49 now feeds the motor of the combined thread drawing-in and return apparatus 51 over the line 50 in the forward direction. The drawing-in from the rotor 11 begins. After the start of the apparatus 51, the thread unwinding follows proportional to the rotor speed.

Through the onset of the memory 62, a digital/analog circuit 70 simultaneously is connected to a line 71 over a line 69. The line 71 is coupled to a tachometer generator 72, which is coupled to the apparatus 51. The line 71 has, therefore, a voltage proportional to the unwinding speed. This voltage now travels from the circuit 70 to the input of the potentiometer 37 over a line 73. The drawing-in speed therefore now follows while taking the adjustable draft of the unwinding speed, at the potentionmeter 37, into account. The erasing of the memory 58 previously resulted in switching off the circuit 32.

After starting the apparatus 40 and 51 in the operational spinning state, the voltage of the collecting main 35, which comes from a direct current source, can be applied at the erasing input 75 of the memory 62 by closing a circuit 74. With the erasing of the memory 62 the apparatus 40 and 51 then go out of operation. However, this is only wise when the normal spinning operation has its own existing drives.

FIG. 3 shows another embodiment example of a block circuit diagram of a control apparatus 77, which helps start the thread joining process according to the rotor speed. The same components in the same circuit as in FIG. 2 exist in FIG. 3 with following exceptions:

A function generator 78 is connected to the output of the counter 19, which delivers a measured variable D to its output 79. The measuring variable D expresses the difference between the given rotor speed for the beginning of the starting process of the thread unwinding, and a measured variable E. The measured variable E is not given out. The measured variable E is an expression for the quotient from the given rotor speed, which is multiplied for the beginning of the starting process of the thread unwinding by the time difference between the starting point of time of the first thread joining step and the beginning of the starting process of the thread unwinding, divided by the given rotor starting time, until the beginning of the starting process of the thread unwinding. The calculator of the previous embodiment is omitted. The second counter 22 is also omitted. Therefore, the comparator 24, which serves as a starting element, is connected with one control input to the output 79 of the function generator 78 and with the other control input to a line 80, which is connected with the line 17. The line 80 has a voltage intensity of the value of a measured variable C, which is an expression for the rotor speed. The two measuring variables C and D lead into the comparator 24. The value of the measured variable C is equal to or larger than the value of the measured variable D, the comparator 24 connects through, and the thread joining process now runs as already explained in FIG. 2.

According to all of the embodiment examples of the invention, the beginning of the starting process of the thread unwinding was chosen as that thread joining step from which the points of time of other thread joining steps are measured. Although this is very expedient, strictly speaking it is not imperative. Alternatively, for example, it could also proceed from the point of time of the fiber feeding, from a starting point in time of the sliver drawing-in, or from a fictitious thread joining step, which is situated close to the starting point in time of the thread unwinding.

The foregoing is a description corresponding to German Application P 31 44 776.7, dated Nov. 11, 1981, the International priority of which is being claimed for the instant application and which is hereby made part of this application. Any discrepancies between the foregoing specification and the aforementioned corresponding German application are to be resolved in favor of the latter.

We claim:

1. Method for controlling a thread joining process having several thread joining steps and occuring by starting a rotor of an open end rotor spinning machine, which comprises performing a first thread joining step, adjusting the speed of the rotor in a narrow limited range for the beginning of a starting process of another thread joining step which occurs after the first thread joining step, selectively starting and finishing additional thread joining steps in substantially constant given intervals before and after the beginning of the starting process, beginning the first thread joining step with the start of pre-feeding a fiber quantity into the rotor being necessary for thread joining, starting the return of the joined thread end to the rotor in given intervals, selectively decreasing and interrupting the pre-feeding, restarting fiber feeding, stopping a decrease in fiber feeding, and beginning unwinding of the thread from the rotor.

2. Method for controlling a thread joining process having several thread joining steps and occuring by starting a rotor of an open end rotor spinning machine, which comprises performing a first thread joining step, adjusting the speed of the rotor in a narrow limited range for the beginning of a starting process of another thread joining step which occurs after the first thread joining step, selectively starting and finishing additional thread joining steps in substantially constant given intervals before and after the beginning of the starting process, determining at least one measured numerical variable based on rotor acceleration during rotor starting, starting the first thread joining step in dependence on the value of the measured numerical variable, selectively starting and finishing the additional thread joining steps at given intervals, measuring the speed of the rotor for the production of the measured numerical variable based on rotor acceleration, and differentiating the measured numerical variable according to time with a calculator.

3. Method for controlling a thread joining process having several thread joining steps and occuring by starting a rotor of an open end rotor spinning machine, which comprises performing a first thread joining step, adjusting the speed of the rotor in a narrow limited range for the beginning of a starting process of another thread joining step which occurs after the first thread joining step, selectively starting and finishing additional thread joining steps in substantially constant given intervals before and after the beginning of the starting process, determining at least one measured numerical variable based on rotor acceleration during rotor starting, starting the first thread joining step in dependence on the value of the measured numerical variable, selectively starting and finishing the additional thread joining steps at given intervals, counting the number of revolutions of the rotor during starting, and starting the first thread joining step after a given point in time is reached, the at least one measured numerical variable being a first measured numerical variable having a value and a second measured numerical variable having a value being smaller than the first measured numerical variable, expressing the number of revolutions of the rotor with the first measured numerical variable, and multiplying the given rotor speed for the beginning of the starting process of the thread unwinding by the square of the starting time and the sum of the given time intervals between the start of the first thread joining step and the beginning of the starting process of the thread unwinding and the starting time of the rotor forming a second measured numerical variable.

4. Method according to claim 3, which comprises measuring the second measured numerical variable from the beginning and feeding the second measured numerical variable to a memory for storage, continuously comparing the value of the second measured numerical variable belonging to the momentary starting time with the first measured numerical variable by starting the rotor, and starting the first thread joining step when the value of the first measured numerical variable is at least as large as the value of the second measured numerical variable.

5. Method for controlling a thread joining process having several thread joining steps and occuring by starting a rotor of an open end rotor spinning machine, which comprises performing a first thread joining step, adjusting the speed of the rotor in a narrow limited range for the beginning of a starting process of another thread joining step which occurs after the first thread joining step, selectively starting and finishing additional thread joining steps in substantially constant given intervals before and after the beginning of the starting process, measuring the number of revolutions of the rotor during a constant given starting time, and increasing the number of measured revolutions as the start of the first thread joining step is carried out earlier in time.

6. Method for controlling a thread joining process having several thread joining steps and occuring by starting a rotor of an open end rotor spinning machine, which comprises performing a first thread joining step, adjusting the speed of the rotor in a narrow limited range for the beginning of a starting process of another thread joining step which occurs after the first thread joining step, selectively starting and finishing additional thread joining steps in substantially constant given intervals before and after the beginning of the starting process, measuring the necessary starting time when reaching a given number of revolutions of the rotor, and shortening the measured starting time as the start of the first thread joining step is carried out earlier in time.

7. Method according to claim 3, which comprises continuously measuring the rotor speed during starting and starting the first thread joining step after reaching a given point in time, the at least one measured numerical variable including a third measured numerical variable having a value, a fourth measured numerical variable having a value being smaller than the value of the third measured numerical variable and a fifth measured numerical variable, expressing the rotor speed with the third measured numerical variable, expressing the difference between the given rotor speed for the beginning of the starting process of the thread unwinding and a fifth measured numerical variable with the fourth measured numerical variable, forming the fifth measured numerical variable by multiplying the given rotor speed for the beginning of the starting process of the thread unwinding by the time difference between the starting time of the first thread joining step and the beginning of the starting process of the thread unwinding, divided by the given rotor running time until the beginning of the starting process of the thread unwinding.

8. Method according to claim 7, which comprises selecting assumed values of the fourth measured numerical variable for different starting times, feeding the assumed values into a memory for storage before thread joining, comparing the value of the third measured numerical variable with the assumed value of the fourth measured numerical variable corresponding to a respective starting time when starting the rotor, and starting the thread joining process after reaching a point in time at which the value of the third measured numerical variable is at least as large as the value of the fourth measured numerical variable.

9. Method according to claim 8, which comprises transferring the memory function to an electrical capacitor being loaded at the beginning of the starting of the rotor, simultaneously continuously comparing a voltage being proportional to the rotor speed with the capacitor voltage, and starting the thread joining process after reaching a point in time at which both of the voltages are equal.

10. Apparatus for controlling a thread joining process having several thread joining steps and occuring by starting a rotor of an open end rotor spinning machine, comprising at least one spinning unit of the open end rotor spinning machine, a control device connected to said at least one spinning unit for controlling pre-feeding of a fiber quantity required for thread joining and for controlling fiber feeding to the rotor, for returning the joined thread end to the rotor and for at least temporarily controlling thread unwinding from the rotor for the duration of the joining process, a thread unwinding device and a sliver drawing-in device connected to the control device at least for the duration of the thread joining process, said control device including an adjustable timer connected to said thread unwinding and sliver drawing-in devices for timing the sequence and duration of individual thread joining steps of the thread joining process, means disposed in vicinity of the rotor for production of electrical rotor signals proportional to the speed of the rotor, means connected to said signal production means for evaluating at least one measured numerical variable from the rotor signals based on acceleration of the rotor, and an electrical start switch having an input connected to said evaluating means for responding to a selectable value of said measured numerical variable and an output connected to said timer for starting a first thread joining step.

11. Apparatus according to claim 10, wherein said thread unwinding device includes a thread returning device, and said timer is formed of a time element for working time of said sliver drawing-in device for pre-feeding, a time element for the starting time of said thread returning device, a time element for the starting time of said sliver drawing-in device for feeding, and a time element for the starting time of said thread unwinding device.

12. Apparatus according to claim 10, wherein said signal production means includes a sender connected to said at least one spinning unit for transmitting digital signals from the rotor, and a receiver acting with said sender for producing the signals.

13. Apparatus according to claim 10, wherein said evaluating means is in the form of a differentiation device for differentiating said rotor signals according to time.

14. Apparatus according to claim 13, wherein said at least one measured numerical variable is in the form of first and second measured numerical variable, said differentiation device includes a counter and a calculator connected down stream of said counter for delivering said second measured numerical variable at an output thereof expressing a quotient, said quotient being formed of a given speed of the rotor for the beginning of the starting process of the thread unwinding multiplied by the square of the starting time and the sum of a given time interval between the start of the first thread joining step and the beginning of the starting process of the thread unwinding and the starting time of the rotor, said start switch being in the form of a comparator connected down stream of said calculator, and another counter connected to said signal production means for adding rotor impulses, said other counter having an output connected to said comparator for issuing said first measured numerical variable expressing the number of revolutions of the rotor.

15. Apparatus according to claim 13, wherein said at least one measured numerical variable is in the form of first, second and third measured numerical variables, said differentiation device includes a counter and a function generator connected down stream of said counter, said function generator having an output issuing said second measured numerical variable expressing the difference between a given rotor speed for the beginning of the starting process of the thread unwinding and said third measured numerical variable, said third measured numerical variable expressing a quotient formed of a given rotor speed for the beginning of the starting process of the thread unwinding multiplied by the time difference between the starting point in time of the first thread joining step and the beginning of the starting process of the thread unwinding divided by a desired rotor starting time until the beginning of the starting process of the thread unwinding, said start switch being a comparator connected down stream of said function generator, and including a digital/analog converter being connected to said signal production means and having an output, and a line being connected to said comparator and to said output of said digital/analog converter carrying a voltage proportional to the rotor speed in the form of said first measured numerical variable expressing the rotor speed.

16. Apparatus according to claim 12, including a digital/analog converter connected to said receiver, and an operative connection connected between said digital/analog converter and said thread unwinding device.

17. Apparatus according to claim 16, including another operative connection connected between said thread unwinding device and said sliver drawing-in device, and a potentiometer disposed in said other operative connection for adjusting the draft.

18. Apparatus according to claim 16, including a tachometer generator connected to said thread unwinding device, said other operative connection being connected between said tachometer generator and said sliver drawing-in device, and a potentiometer disposed in said other operative connection for adjusting the draft.

* * * * *